US009702511B2

(12) United States Patent
Streppel et al.

(10) Patent No.: US 9,702,511 B2
(45) Date of Patent: Jul. 11, 2017

(54) LIGHTING DEVICE WITH SEMICONDUCTOR LIGHT SOURCE AND SPACED-APART PHOSPHOR REGION

(71) Applicant: OSRAM GmbH, Munich (DE)

(72) Inventors: Henrike Streppel, Regensburg (DE); Moritz Engl, Regensburg (DE); Dirk Berben, Herdecke (DE); Joerg Frischeisen, Schwabmuenchen (DE); Michael Schoewel, Regensburg (DE)

(73) Assignee: OSRAM GMBH, Munich (DE)

( * ) Notice: Subject to any disclaimer, the term of this patent is extended or adjusted under 35 U.S.C. 154(b) by 315 days.

(21) Appl. No.: 14/359,583

(22) PCT Filed: Oct. 10, 2012

(86) PCT No.: PCT/EP2012/070024
§ 371 (c)(1),
(2) Date: May 21, 2014

(87) PCT Pub. No.: WO2013/075881
PCT Pub. Date: May 30, 2013

(65) Prior Publication Data

US 2014/0328048 A1 Nov. 6, 2014

(30) Foreign Application Priority Data

Nov. 21, 2011 (DE) ..... 10 2011 086 713

(51) Int. Cl.
*F21V 9/00* (2015.01)
*F21K 9/232* (2016.01)
(Continued)

(52) U.S. Cl.
CPC ..... *F21K 9/232* (2016.08); *F21K 9/64* (2016.08); *F21V 3/0472* (2013.01); *F21V 9/00* (2013.01); *F21V 3/02* (2013.01); *F21Y 2115/10* (2016.08)

(58) Field of Classification Search
CPC ..... H01L 2924/0002; H01L 2924/00; H01L 33/507; H01L 2224/48091;
(Continued)

(56) References Cited

U.S. PATENT DOCUMENTS 8,514,352 B2 * 8/2013 Montgomery .... G02F 1/133615 349/108
2007/0018102 A1 1/2007 Braune et al.
(Continued)

FOREIGN PATENT DOCUMENTS

CN 1823428 A 8/2006
CN 101960918 A 1/2011
(Continued)

OTHER PUBLICATIONS

International Search Report of PCT/EP2012/070024 mailed on Jan. 24, 2013.
(Continued)

*Primary Examiner* — Stephen F Husar
(74) *Attorney, Agent, or Firm* — Viering, Jentschura & Partner mbB

(57) ABSTRACT

A lighting may include at least one semiconductor light source which emits primary light, at least one phosphor region spaced apart from the at least one semiconductor light source and serving for at least partly converting the primary light into secondary light, and at least one filter disposed downstream of the at least one phosphor region, wherein the at least one filter is partly reflective at least to the primary light.

11 Claims, 2 Drawing Sheets

(51) Int. Cl.

| | |
|---|---|
| ***F21V 3/04*** | (2006.01) |
| ***F21K 9/64*** | (2016.01) |
| *F21V 3/02* | (2006.01) |
| *F21Y 115/10* | (2016.01) |

(58) Field of Classification Search

CPC ..... H01L 2924/12041; H01L 33/504; H01L 2224/49107; H01L 2924/00014; H01L 33/44; H01L 33/50; H01L 33/502; H01L 33/505; H01L 2224/48247; H01L 2224/48257; H01L 2224/73265; H01L 2224/85385; H01L 24/32; H01L 25/0753; H01L 27/124; H01L 27/1248; H01L 27/322; H01L 27/323; H01L 27/3244; H01L 27/3246; H01L 27/3258; H01L 27/3276; H01L 2933/0041; H01L 33/46; H01L 33/508; H01L 33/56; H01L 51/52; H01L 51/5284; F21V 9/00; F21V 13/06; F21V 13/08; F21V 23/04; F21V 9/08; F21V 23/003; F21V 23/0457; F21V 23/06; F21V 29/507; F21V 33/0044; F21V 33/0064; F21V 3/02; F21V 3/0409; F21V 3/0427; F21V 3/0445; F21V 3/0472; G02B 1/04; G02B 5/201; G02B 5/223; G02B 5/28; G02B 5/3083; G02B 21/0076; G02B 21/06; G02B 26/008; G02B 2207/101; G02B 2207/113; G02B 26/001; G02B 5/0242; G02B 5/20; G02B 5/206; G02B 5/226; G02B 5/285; G02B 5/3058; F21K 2/00; F21K 9/135; F21K 9/17; F21K 9/56; F21K 9/64; F21K 9/232; F21S 10/007; F21S 4/28; F21S 8/026; F21Y 2115/10

See application file for complete search history.

(56) References Cited

U.S. PATENT DOCUMENTS

| | | | |
|---|---|---|---|
| 2008/0231162 | A1 | 9/2008 | Kurihara et al. |
| 2009/0103293 | A1 | 4/2009 | Harbers et al. |
| 2010/0149814 | A1 | 6/2010 | Zhai et al. |
| 2010/0327745 | A1 | 12/2010 | Dassanayake et al. |
| 2011/0175518 | A1 | 7/2011 | Reed et al. |
| 2012/0300432 | A1 | 11/2012 | Matsubayashi et al. |

FOREIGN PATENT DOCUMENTS

| | | | |
|---|---|---|---|
| GB | 2477569 | A | 8/2011 |
| WO | 2007113777 | A2 | 10/2007 |
| WO | 2009107052 | A1 | 9/2009 |
| WO | 2011108203 | A1 | 9/2011 |

OTHER PUBLICATIONS

Chinese Office Action based on Application No. 2012800570714(8 Pages and 6 pages of English translation) dated May 24, 2016 (Reference Purpose Only).

* cited by examiner

LIGHTING DEVICE WITH SEMICONDUCTOR LIGHT SOURCE AND SPACED-APART PHOSPHOR REGION

RELATED APPLICATIONS

The present application is a national stage entry according to 35 U.S.C. §371 of PCT application No.: PCT/EP2012/070024 filed on Oct. 10, 2012, which claims priority from German application No.: 102011086713.9 filed on Nov. 21, 2011, and is incorporated herein by reference in its entirety.

TECHNICAL FIELD

Various embodiments relate to a lighting device, including at least one semiconductor light source which emits primary light, and at least one phosphor region ("remote phosphor") spaced apart from the at least one semiconductor light source and serving for at least partly converting the primary light into secondary light. Various embodiments are preferably applicable to retrofit lamps.

BACKGROUND

In lighting devices of the relevant type which are present as white-emitting LED lamps, a blue light emitted by light-emitting diodes (LEDs) is at least partly converted into yellow light in the phosphor region. In total, a blue-yellow or white mixed light is thus emitted by the phosphor region. The phosphor region appears yellow when viewed from outside with an LED lamp switched off. This yellow appearance is intended to be avoided, however, in many applications.

LED lamps are known in which the phosphor region is covered by a diffusely scattering bulb. As a result, the yellow phosphor region shows only slightly through the bulb. In this case, the phosphor cannot be arranged on the exterior of the outer bulb, since the yellow impression is then too strong. Internal phosphor is thermally disadvantageous, however, since it is not cooled by ambient air.

Conventional incandescent lamps of the DIADEM type from Osram are known for use as indicator luminaries in automotive engineering, said lamps having a blue filter on their bulb. By means of the blue filter, the blue component is filtered out from the wide optical spectrum of the incandescent lamp (that is to say is reflected back into the lamp), such that only yellow or yellowish light emerges.

SUMMARY

Various embodiments provide a lamp of the relevant type mentioned which has an improved appearance with at the same time a possibility of diverse beam shaping.

Various embodiments provide a lighting device, including at least one semiconductor light source which emits light in a first spectral range ("primary light"), at least one phosphor region spaced apart from the at least one semiconductor light source and serving for at least partly converting the primary light into light in a second spectral range ("secondary light"), and at least one filter disposed downstream of the at least one phosphor region, wherein the at least one filter is partly reflective at least to the primary light.

The circumstance that the at least one filter is partly reflective at least to the primary light can encompass both the fact that at least one filter is partly reflective (and consequently partly transmissive) only to the primary light and is not reflective for example to the secondary light, and (alternatively or additionally) the fact that at least one filter is partly reflective (and consequently in each case partly transmissive) to the primary light and also to the secondary light. By contrast, complete reflection of the primary light is not provided.

The fact that the at least one filter is disposed downstream of at least one phosphor region can mean, in particular, that the at least one filter is situated behind the at least one phosphor region in the beam path of the primary light in the switched-on state of the lighting device (with at least one semiconductor light source activated). In the opposite direction in the event of light being radiated in from outside, the at least one filter is arranged in front of the at least one phosphor region.

By means of a filter, the light incident on the lighting device from outside, at least in the spectral range encompassing the primary light, is reflected back and thus increases its proportion of the mixed light, such that the latter appears less in the color of the secondary light, e.g. yellow, than without the presence of the filter.

In the switched-on state, the further advantage arises that part of the primary light reflected back by the filter in the direction of the at least one phosphor region is wavelength-converted or converted by the at least one phosphor region and thus less phosphor is required in order to obtain a specific color locus. By virtue of this effect, costs for phosphors can be reduced.

The partly transmissive filter can in particular also be designated as a partly transmissive reflector or mirror.

The at least one phosphor region can include one or a plurality of phosphors. If the at least one phosphor region includes a plurality of phosphors, a phosphor region may include only one phosphor and/or a phosphor region may include a plurality of phosphors.

In one configuration, the at least one filter is a metallic mirror layer. A metallic mirror layer is (partly) reflective in particular in a broadband fashion in the visible light spectrum. In the case of such a metallic partly transmissive mirror, in the switched-off state of the lighting device, the yellow color impression of the at least one phosphor region is alleviated by virtue of the fact that predominantly the more broadband light reflected by the mirror layer is visible. The metallic mirror layer has the advantage, inter alia, that it can be applied particularly simply and inexpensively.

The mirror layer can be in particular a silver layer. The latter has a particularly low absorptance and a high reflectance.

In another configuration, the at least one filter is an interference filter. An interference filter is typically constructed as an interference layer system which can partly reflect primary light, while secondary light is transmitted substantially completely. In the switched-off state, the lighting device no longer appears in the color of the secondary light, since a significant part of the primary light proportion of the white light incident from the surroundings is reflected at the interference filter. The light transmitted into the lighting device from outside (that is to say a remainder of the primary light and the uninfluenced spectral remainder) experiences in the spectral range of the primary light at the phosphor region an absorption and subsequent partial wavelength conversion with emission; the remainder can be reflected in particular without wavelength conversion. However, since part of the primary light was already reflected at the interference filter, an overall impression which is at least approximated to that of the mixed light can be established again outside the interference filter as a result of a spectral superimposition.

In the switched-on state, part of the primary light and the secondary light pass through the layer toward the outside.

One advantage of the interference filter is that the secondary light is transmittable without significant losses.

Overall this leads to low losses of the lighting device. In particular, the at least one partly reflective phosphor region is comparatively sharply and precisely adjustable, such that spectral ranges lying outside said at least one partly reflective spectral range are hardly impaired by the interference filter.

In principle, toward the outside a color impression is adjustable by a reflectance of the interference filter being correspondingly adapted, which is achievable e.g. by means of a variation of a number, structure and/or order of the layers of the (interference) filter.

In a further configuration, the partly transmissive filter includes alternating layers composed of SiO2 and TiO2.

In yet another configuration, the at least one semiconductor light source includes at least one semiconductor light source which emits blue primary light, in particular in a spectral range of between 440 nm and 480 nm. Blue light has the advantage that it is at the short-wave end of the visible spectrum and can thus be converted by down conversion into many other colors, e.g. into green, yellow, orange and/or red, etc. The interference filter can then be in particular a "blue filter".

If the primary light is a short-wave blue light, in particular in a spectral range of between 440 nm and 460 nm, it can also be converted into blue light having a longer wavelength by means of a suitable phosphor.

Therefore, in one configuration, moreover, the partly transmissive filter constitutes a filter for short-wave blue light, in particular in a range of between 440 nm and 460 nm.

In one configuration, in addition, the at least one phosphor region converts the primary light in order to generate a white mixed light. In this regard, in particular a light color generated by many conventional lamps can be imitated. The white light can be e.g. warm-white or cold-white.

In one configuration, furthermore, the at least one phosphor region converts the primary light into yellow to red (that is to say yellow, orange and/or red) secondary light. As a result, in particular in the case of a semiconductor light source which emits blue primary light, a white, in particular warm-white, mixed light can be generated. However, for example in order to generate an orange light proportion or red light proportion, provision may be made of at least one semiconductor light source which emits light in such a spectral range, in particular without further light conversion.

In one configuration, generally, the lighting device includes at least one semiconductor light source which emits light which is not wavelength-converted by the lighting device. Such light which is not to be wavelength-converted can include for example orange, red and/or green light, in particular if the primary light to be wavelength-converted is blue light.

Preferably, the at least one semiconductor light source includes at least one light-emitting diode. In the case where a plurality of light-emitting diodes are present, they can emit light in the same color or different colors. A color can be monochromatic (e.g. red, green, blue, etc.) or multichromatic (e.g. white). Moreover, the light emitted by the at least one light-emitting diode can be an infrared light (IR LED) or ultraviolet light (UV LED). A plurality of light-emitting diodes can generate a mixed light; e.g. a white mixed light. The at least one light-emitting diode may contain at least one wavelength-converting phosphor (conversion LED). The at least one light-emitting diode may be present in the form of at least one individually packaged light-emitting diode or in the form of at least one LED chip. A plurality of LED chips can be mounted on a common substrate ("submount"). The at least one light-emitting diode may be equipped with at least one dedicated and/or common optical unit for beam guiding, e.g. at least one Fresnel lens, collimator, and so on. Instead of or in addition to inorganic light-emitting diodes, e.g. based on InGaN or AlInGaP, organic LEDs (OLEDs, e.g. polymer OLEDs) may generally also be used. Alternatively, the at least one semiconductor light source can include e.g. at least one diode laser.

In one configuration, moreover, the filter is (also) disposed (directly) downstream of the at least one semiconductor light source. A high diversity in terms of lighting design is provided as a result. By way of example, the primary light emitted by the at least one semiconductor light source can be incident substantially completely on the at least one phosphor region. Alternatively, one part of the light emitted by the at least one semiconductor light source may be incident on the at least one phosphor region, but another part may run past the at least one phosphor region. In another development including a plurality of semiconductor light sources, one portion of the semiconductor light sources can at least partly irradiate the at least one semiconductor luminous region and in this case be (at least partly) wavelength-converted and light of another portion of the semiconductor light sources can be (completely) not wavelength-converted.

In one development, the at least one filter is arranged in such a way that it covers the at least one phosphor region such that a direct view of the at least one phosphor region from outside is prevented or impossible, rather the at least one phosphor region can be viewed only through the filter.

In another development, the filter covers a light exit opening of a receptacle space which is at least substantially open on one side and serves for receiving the at least one phosphor region and/or the at least one semiconductor light source. Such a receptacle space can be for example a housing of a module or a reflector, in particular hollow reflector, e.g. of a halogen lamp retrofit lamp.

In one development, furthermore, the at least one filter covers or curves over the at least one phosphor region. The at least one filter can therefore in particular project (radially) laterally beyond the at least one phosphor region (in particular from outside in a plan view of the at least one filter) or cover it at least as far as an identical lateral position.

In one configuration, moreover, free surfaces of the lighting device which are covered by the filter are configured such that they are (diffusely and/or specularly) reflective. Light losses, including light reflected back by the filter in the switched-on state, can be reduced as a result. By way of example, a base of a module can be configured such that it is reflective, e.g. by virtue of a diffusely reflective baseplate. In particular, a surface of a carrier (e.g. a ceramic substrate or printed circuit board) carrying the at least one semiconductor light source can be configured such that it is correspondingly reflective outside the at least one semiconductor light source.

In a further configuration, the at least one filter is arranged on the at least one phosphor region. A particularly compact arrangement free of losses is made possible as a result.

In yet another configuration, at least one filter is arranged on at least one light-transmissive cover. In this case, the light-transmissive cover can be spaced apart in particular from the at least one phosphor region. By way of example, the light-transmissive cover may be a light-transmissive bulb which curves over the at least one phosphor region, for example, and on which the filter is applied.

In one configuration, moreover, at least one filter and at least one phosphor region are arranged on a common light-transmissive cover. This enables particularly simple production and a compact design. In particular, the at least one filter may be arranged on one side of a light-transmissive main body of the cover, and the at least one phosphor region on another side. Such a cover can be for example a cover of a module or of a reflector.

In one configuration, in addition, the lighting device is a lamp. For a lamp, in particular, avoiding a non-white color impression in the switched-off state can be advantageous. This applies in particular to a retrofit lamp, which conventionally appears non-colored. The retrofit lamp can be in particular an incandescent lamp retrofit lamp or a halogen lamp retrofit lamp.

In another configuration, the lighting device is a module. In this case, the cover can be in particular a flat or only slightly curved cover which covers a light exit plane of the module. The module can be in particular an LED module.

Various embodiments also provide a method for operating a lighting device, wherein primary light is emitted by at least one semiconductor light source, at least part of the primary light is converted (at least partly into secondary light) at at least one phosphor region spaced apart from the at least one semiconductor light source, and at least the primary light is subsequently partly reflected at at least one filter. The method affords the same advantages as the lighting device and can also be configured analogously.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
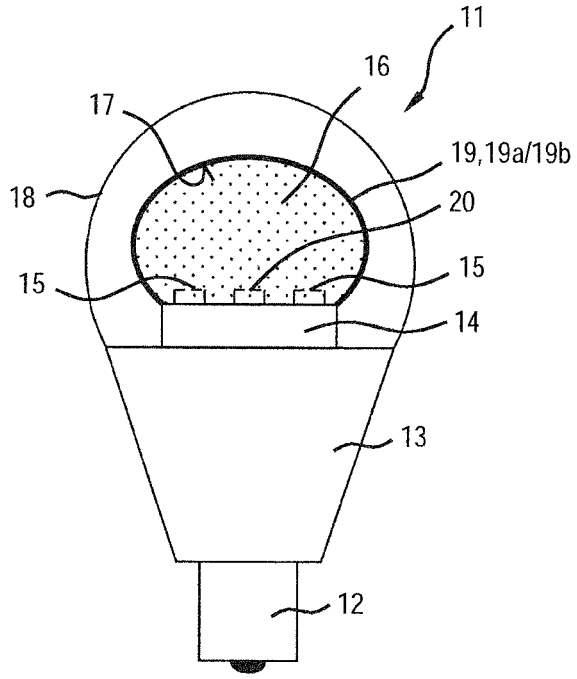
FIG. 1 shows a lighting device in accordance with a first exemplary embodiment in side view.

FIG. 1 shows a lighting device 11 in accordance with a first exemplary embodiment in side view. The lighting device is present as an incandescent lamp retrofit lamp which is provided as a replacement of a conventional incandescent lamp and has at least approximately the outer contour thereof. For mechanical and electrical connection to a lampholder (not illustrated), the lighting device has a base 12, e.g. an Edison base, at a rear end. The base 12 is adjoined toward the front by a heat sink 13, which also constitutes a housing for a driver cavity for receiving a driver. Arranged on a top side of the heat sink 13 is a carrier 14 for carrying a plurality of semiconductor light sources, emitting here: blue primary light, in the form of light-emitting diodes 15 (indicated by dashed lines). A phosphor region in the form of a phosphor layer 16 curves completely over the light-emitting diodes 15. The phosphor layer 16 is spaced apart from the light-emitting diodes 15 and partly converts the blue primary light into yellow secondary light. The phosphor layer 16 appears yellow when viewed in daylight. When the lighting device 11 is switched on with activated light-emitting diodes 15, blue-yellow or white mixed light is thus emitted by the outer surface 17 of the phosphor layer 16.

A light-transmissive cover in the form of a transparent or transient bulb 18 in turn curves over the phosphor layer 16 for the protection thereof and, if appropriate, for influencing a beam shape.

Proceeding from the light-emitting diodes 15, a filter 19 is disposed downstream of the phosphor layer 16. In this exemplary embodiment, the filter 19 is applied directly to the outer surface 17 of the phosphor layer 16, thus resulting in a particularly compact design free of losses. The filter 19 completely covers the phosphor layer 16. The filter 19 is partly transmissive and partly reflective ("semitransparent mirror") at least for the blue primary light.

The filter 19 can be present as a metallic mirror layer in the form of a thin silver layer 19*a*. In this case, when the lighting device 11 is switched off, light incident from outside is partly reflected back over its entire visible spectrum and so the yellow color impression is considerably weakened.

Alternatively, the filter 19 can be configured as an interference filter 19*b*. In this case, a partial transmissivity and partial reflection arise as a result of interference and exhibit particularly low losses as a result. The interference filter 19*b* may act in particular only on the blue primary light, but not on the yellow secondary light. As a result, when the lighting device 11 is switched on, part of the blue primary light is reflected back onto the phosphor region 16, is partly converted there and projected again onto the filter 19. As a result, the primary light proportion is reduced at the outer surface 17, such that less phosphor for the phosphor layer 16 is required for setting a desired color locus.

In the switched-off state of the lighting device 11, the primary light proportion of the light incident from outside is partly reflected, while the spectral remainder is completely incident on the phosphor layer 16. Consequently, the light reflected back toward the outside again will have a higher primary light proportion than without the filter 19*b* and will appear less yellow as a result.

The interference filter 19*b* can include for example a plurality of alternating layers composed of SiO2 and TiO2.

In order to set a warm-white color locus, the lighting device 11 can also include at least one light-emitting diode 20 which emits red light and the light of which likewise impinges (from inside) on the phosphor layer 16, the phosphor layer 16 acting only as a diffuser for the red light, and not as a wavelength converter.

Figure 2:
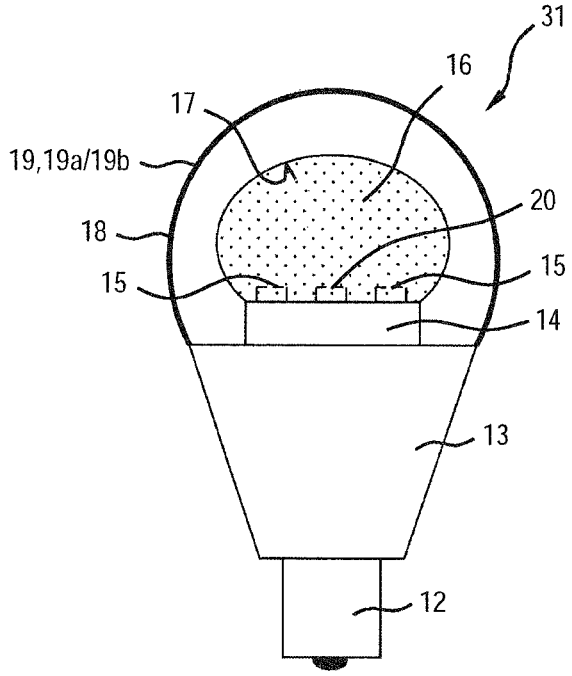
FIG. 2 shows a lighting device in accordance with a second exemplary embodiment in side view.

FIG. 2 shows a lighting device 31 in accordance with a second exemplary embodiment in side view. The lighting device 31 is constructed similarly to the lighting device 11, except that know the filter 19 or 19*a* or 19*b* is arranged on the bulb 18.

Figure 3:
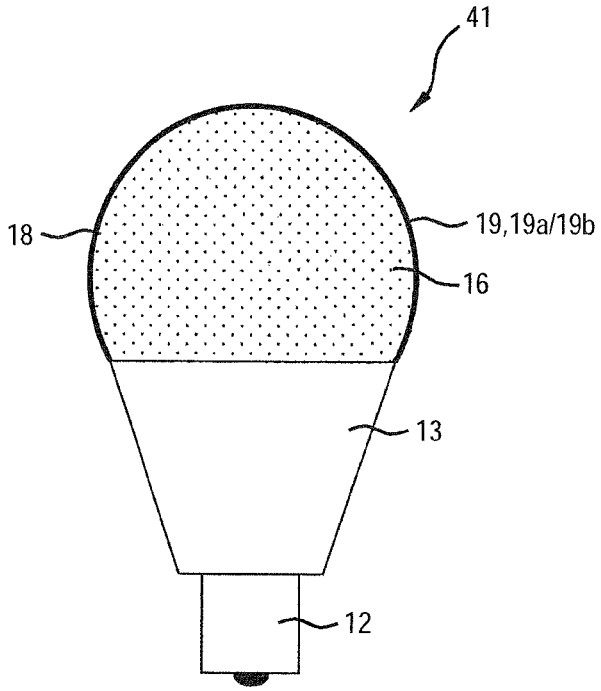
FIG. 3 shows a lighting device in accordance with a third exemplary embodiment in side view.

FIG. 3 shows a lighting device 41 in accordance with a third exemplary embodiment in side view. The lighting device 41 is constructed similarly to the lighting device 31, except that now the phosphor layer 16 and the filter 19 are applied jointly on the bulb 18. The phosphor layer 16 is arranged in the interior in relation to the filter 19 and can for example bear directly on the filter 19 or be separated from the filter 19 by the main body of the bulb 18.

Figure 4:
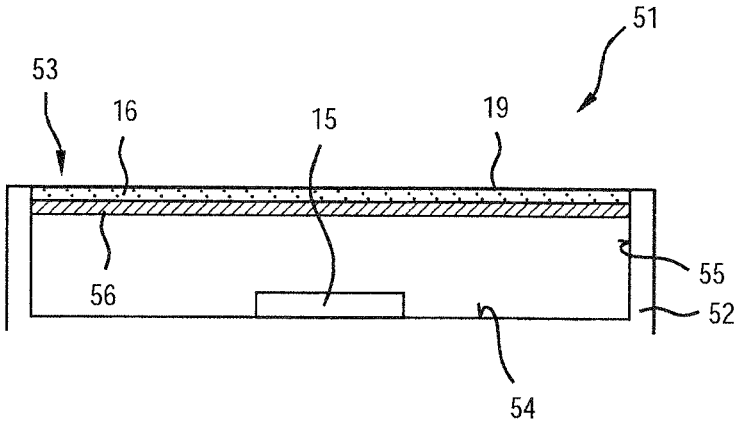
FIG. 4 shows a lighting device in accordance with a fourth exemplary embodiment as a sectional illustration in side view.

FIG. 4 shows a lighting device 51 in accordance with a fourth exemplary embodiment in the form of an LED module as a sectional illustration in side view. The lighting device includes a cup-shaped housing 52 having a light emission opening 53 on the front side. Situated on a base 54 of the housing there is a light-emitting diode 15, which emits blue primary light and which emits the primary light into a front half-space. The base 54 and the side walls 55 are configured as reflective (e.g. as a result of the provision of a corresponding reflection layer, not illustrated), in particular diffusely reflective, in order to avoid light losses.

The light emission opening 53 is colored by a light-transmissive cover in the form of a planar or slightly curved cover plate 56. The cover plate 56 is covered on the top side with the phosphor layer 16 and with the filter 19 or 19*a* or 19*b*, to be precise such that the filter 19 covers the phosphor layer 16. Improved cooling of the phosphor layer 16 is achieved as a result.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

LIST OF REFERENCE SIGNS

11 Lighting device
12 Base
13 Heat sink
14 Carrier
15 Light-emitting diode
16 Phosphor layer
17 Surface
18 Bulb
19 Filter
19*a* Thin silver layer
19*b* Interference filter
20 Light-emitting diode
31 Lighting device
41 Lighting device
51 Lighting device
52 Housing
53 Light emission opening
54 Base
55 Side wall
56 Cover plate

The invention claimed is:

1. A lighting device, comprising at least one semiconductor light source which emits blue primary light, at least one phosphor region spaced apart from the at least one semiconductor light source and serving for at least partly converting the blue primary light into yellow to red secondary light in order to generate white mixed light, and at least one filter being situated behind the at least one phosphor region in the beam path of the blue primary light emitted by the at least one semiconductor light source, wherein the at least one filter is a semitransparent mirror which is partly reflective at least to the blue primary light and which completely covers the at least one phosphor region, and the lighting device comprises at least one additional semiconductor light source which emits red light which is not wavelength-converted.

2. The lighting device as claimed in claim 1, wherein the at least one filter is a metallic mirror layer.

3. The lighting device as claimed in claim 1, wherein the at least one filter is an interference filter.

4. The lighting device as claimed in claim 3, wherein the at least one filter comprises alternating layers composed of SiO2 and TiO2.

5. The lighting device as claimed in claim 1, wherein the at least one filter is also disposed downstream of the at least one semiconductor light source.

6. The lighting device as claimed in claim 1, wherein the at least one phosphor region converts the blue primary light into yellow to red secondary light.

7. The lighting device as claimed in claim 1, wherein the at least one filter is partly transmissive and constitutes a filter for short-wave blue light.

8. The lighting device as claimed in claim 1, wherein the at least one filter is arranged on the at least one phosphor region.

9. The lighting device as claimed in claim 1, wherein the at least one filter is arranged on at least one light-transmissive cover.

10. The lighting device as claimed in claim 1, wherein the at least one filter and the at least one phosphor region are arranged on a common light-transmissive cover.

11. The lighting device as claimed in claim 1, wherein the lighting device is a lamp or a module.

* * * * *